US011559119B2

(12) United States Patent
Shi

(10) Patent No.: US 11,559,119 B2
(45) Date of Patent: Jan. 24, 2023

(54) CONNECTION ASSEMBLY AND WEARABLE DEVICE

(71) Applicant: Beijing Xiaomi Mobile Software Co., Ltd., Beijing (CN)

(72) Inventor: Guangbin Shi, Beijing (CN)

(73) Assignee: Beijing Xiaomi Mobile Software Co., Ltd., Beijing (CN)

( * ) Notice: Subject to any disclaimer, the term of this patent is extended or adjusted under 35 U.S.C. 154(b) by 0 days.

(21) Appl. No.: 17/453,760

(22) Filed: Nov. 5, 2021

(65) Prior Publication Data

US 2022/0369770 A1 Nov. 24, 2022

(30) Foreign Application Priority Data

May 18, 2021 (CN) ..... 202110539803.4

(51) Int. Cl.
*A44C 5/14* (2006.01)

(52) U.S. Cl.
CPC ..... *A44C 5/14* (2013.01)

(58) Field of Classification Search
CPC ..... A44C 5/14; A44C 5/0007; G04B 37/1486
See application file for complete search history.

(56) References Cited

U.S. PATENT DOCUMENTS

| | | | | |
|---|---|---|---|---|
| 10,184,506 | B2 * | 1/2019 | Chen | G04B 37/1486 |
| 10,219,591 | B2 * | 3/2019 | Hatanaka | G04B 37/1486 |
| 10,327,520 | B1 | 6/2019 | Ely | |
| 10,365,614 | B2 * | 7/2019 | Von Allmen | G04B 37/1493 |
| 10,418,693 | B2 * | 9/2019 | Xu | G04G 17/04 |
| 10,448,711 | B2 * | 10/2019 | Kallman | H01R 13/2428 |
| 10,524,549 | B2 * | 1/2020 | Wang | G04B 37/08 |
| 10,542,794 | B2 * | 1/2020 | McCray | A44C 5/0007 |
| 10,646,007 | B2 * | 5/2020 | McCray | A44C 5/0084 |
| 10,820,669 | B2 * | 11/2020 | Chen | G04B 37/1486 |
| 11,357,293 | B2 * | 6/2022 | Hu | A44C 5/0007 |
| 2002/0089193 | A1 * | 7/2002 | Terasawa | A44C 5/0007 292/323 |

(Continued)

FOREIGN PATENT DOCUMENTS

| | | | |
|---|---|---|---|
| CN | 205696116 | U | 11/2016 |
| CN | 106858937 | A | 6/2017 |

(Continued)

*Primary Examiner* — Robert Sandy
*Assistant Examiner* — Louis A Mercado
(74) *Attorney, Agent, or Firm* — McCoy Russell LLP

(57) ABSTRACT

A connection assembly includes: a support member including a support body and an accommodating groove in the support body; a first clamping member including a fixing part and a first clamping part, the fixing part and the support member being buckled to form an accommodating space with the accommodating groove, the accommodating space having an opening, and the first clamping part is detachably clamped to a first clamping groove in a to-be-connected body by an external force; a second clamping member including a second clamping part which is at least partially in the accommodating space and can be extended or retracted from the opening of the accommodating space to be clamped into or separated from a second clamping groove in the to-be-connected body; and a clamping face of the first clamping part and a clamping face of the second clamping part that are in different planes.

12 Claims, 4 Drawing Sheets

(56) References Cited

U.S. PATENT DOCUMENTS

| | | | | |
|---|---|---|---|---|
| 2014/0098649 | A1* | 4/2014 | Tschumi ..... | G04B 37/1486<br>368/282 |
| 2016/0037876 | A1 | 2/2016 | Perkins et al. | |
| 2016/0262504 | A1* | 9/2016 | Schooley ..... | G04B 37/1486 |
| 2020/0405017 | A1 | 12/2020 | Hu et al. | |

FOREIGN PATENT DOCUMENTS

| | | | |
|---|---|---|---|
| CN | 210539308 | U | 5/2020 |
| CN | 111552168 | A | 8/2020 |
| CN | 211354127 | U | 8/2020 |
| CN | 212938383 | U | 4/2021 |

* cited by examiner

CONNECTION ASSEMBLY AND WEARABLE DEVICE

CROSS-REFERENCE TO RELATED APPLICATION

The present application claims priority to Chinese Application No. 202110539803.4 filed on May 18, 2021. The entire contents of the above-listed application is hereby incorporated by reference for all purposes.

BACKGROUND

With the development of wearable devices and the needs of users, smartwatches or smart bracelets have become popular smart wearable electronic devices, watchbands or wristbands acting as connection carriers need to not only conform to human engineering and but also be disassembled conveniently during use of the smartwatches or smart bracelets.

During use, a user has higher requirements not only on the functionality and performance of an electronic device, but also on accessories of connection carriers. the connection carriers are prone to damage during repeated use. Specifically chain-type metal watchbands and plastic watchbands with diversified appearances need to be replaced frequently, and additionally, connection carriers in different styles also need to be replaced frequently due to the pursuit of personalized styles by users.

SUMMARY

The disclosure relates to the technical field of wearable devices, and relates to a connection assembly and a wearable device.

According to a first aspect of the disclosure, a connection assembly is provided, including:

a support member, including: a support body and an accommodating groove on the support body;

a first clamping member, including: a fixing part and a first clamping part, the fixing part and the support member being buckled to form an accommodating space with the accommodating groove, the accommodating space having an opening, and the first clamping part is detachably clamped to a first clamping groove in a to-be-connected body by an external force;

a second clamping member, including: a second clamping part which is at least partially in the accommodating space and can be extended or retracted from the opening of the accommodating space to be clamped into or separated from a second clamping groove; and a clamping face of the first clamping part and a clamping face of the second clamping part are in different planes.

In a second aspect of the disclosure, a wearable device is provided, including:

a device body, including: a first clamping groove and a second clamping groove;

a band-shaped connector;

the connection assembly, including:

a support member is connected to the band-shaped connector, and includes a support body and an accommodating groove on the support body;

a first clamping member, including: a fixing part and a first clamping part, the fixing part and the support member being buckled to form an accommodating space with the accommodating groove, the accommodating space having an opening, and the first clamping part is detachably clamped to the first clamping groove by an external force;

a second clamping member, including: a second clamping part which is at least partially in the accommodating space and can be extended or retracted from the opening of the accommodating space to be clamped into or separated from the second clamping groove;

a clamping face of the first clamping part and a clamping face of the second clamping part are in different planes;

in a wearing state, the connection assembly, the band-shaped connector and the device body form a wearing loop.

It should be understood that both the foregoing general description and the following detailed description are explanatory only and cannot limit the disclosure.

BRIEF DESCRIPTION OF THE DRAWINGS

The accompanying drawings herein, which are incorporated in and constitute a part of the description, illustrate embodiments consistent with the disclosure and, together with the description, serve to explain the principles of the disclosure.

DETAILED DESCRIPTION

Embodiments will be described in detail herein, and examples of the embodiments are illustrated in the accompanying drawings. When the following description refers to accompanying drawings, the same numerals in different drawings refer to the same or similar elements unless otherwise indicated. The implementations described in the following examples do not represent all implementations consistent with the disclosure. On the contrary, they are examples of devices and methods consistent with some aspects of the disclosure.

The connection carriers in existing wearable devices are generally connected by integration or by lugs and spring bars. However, the connection achieved by the integration cannot meet the demand on repairing or replacing the connection carriers; and connection achieved by the lugs and the spring bars has the problem that the disassembly is inconvenient.

Figure 1:
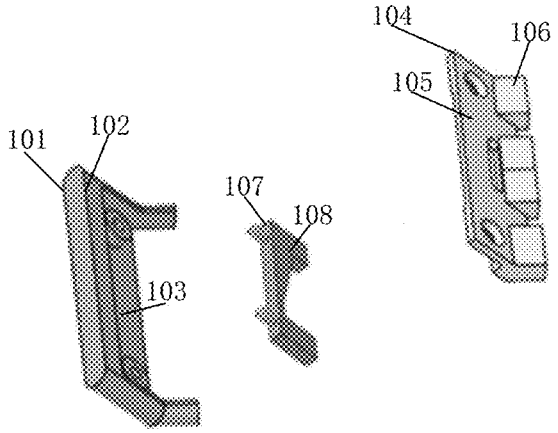
FIG. 1 is a schematic diagram I illustrating a connection assembly according to an embodiment.

FIG. 1 is a schematic diagram I illustrating a connection assembly according to an embodiment. As shown in FIG. 1 which is a schematic diagram of disassembly of a connection assembly, the connection assembly includes:

a support member 101, including: a support body 102 and an accommodating groove 103 on the support body 102;

a first clamping member 104, including: a fixing part 105 and a first clamping part 106, the fixing part 105 and the support member 101 being buckled to form an accommodating space with the accommodating groove 103, the accommodating space having an opening, and the first clamping part 106 is detachable clamped to a first clamping groove in a to-be-connected body by an external force;

a second clamping member 107, including: a second clamping part 108 which is at least partially in the accommodating space and can be extended or retracted from the opening of the accommodating space to be clamped into or separated from a second clamping groove in the to-be-connected boy; and a clamping face of the first clamping part 106 and a clamping face of the second clamping part 108 are in different planes.

Figure 2:
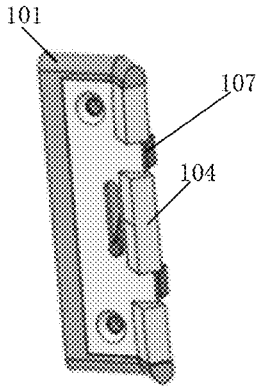
FIG. 2 is a schematic diagram II illustrating a connection assembly according to an embodiment.

FIG. 2 is a schematic diagram II illustrating a connection assembly according to an embodiment, and as shown in FIG. 2 which is a schematic diagram of assembly of the connection assembly, the support member 101, the first clamping member 104 and the second clamping member 107 form the connection assembly together.

In some embodiments, the connection assembly may be a separate assembly for enabling an interconnection function, for example, the support member of the connection assembly may be connected to a band-shaped connector 4 and the first and second clamping parts are connected to the to-be-connected body to achieve a detachable connection between the band-shaped connector 4 and the to-be-connected body. In other embodiments, the connection assembly may be a part of the band-shaped connector 4, i.e., the connection assembly may also be integrally formed with the band-shaped connector 4.

By taking the band-shaped connector 4 being a watchband of a smartwatch 2 as an example, the watchband has a curved shape, the connection assembly can be used to connect the watchband and a watch face 21 in the smartwatch 2; and alternatively, the band-shaped connector 4 is a wristband of a smart bracelet 3, the wristband has a curved shape, the connection assembly is used to connect the wristband and a bracelet display screen 32 in the smart bracelet 3. In some embodiments, when the band-shaped connector 4 has a curved shape, the connection assembly may also be set to have a curved shape.

Figure 3:
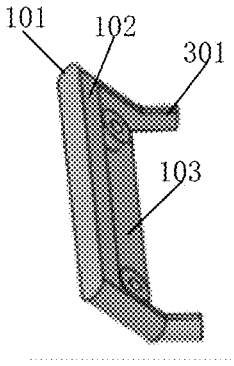
FIG. 3 is a schematic diagram illustrating a support member according to an embodiment.

In some embodiments, the support member may be set to be in a curved shape. FIG. 3 is a schematic diagram illustrating the support member 101 according to an embodiment. As shown in FIG. 3, walls on two sides of the accommodating groove 103 in the support body 102 may extend to form extension parts 301, and a curved shape is formed based on the extension parts 301 and side walls on the two sides of the accommodating groove 103. Correspondingly, the fixing part 105 and the first clamping part 106 of the first clamping member 104 may together form a curved shape.

In some embodiments, the curved shape formed by the extension parts on the support member and the side walls on the two sides of the accommodating groove are has the same curving angle as the curved shape formed by the fixing part and the first clamping part of the first clamping member, so that the fixing part is totally matched with the support member when the fixing part and the support member are buckled.

In some embodiments, when a to-be-connected object is a watch face 21, the connection assembly is detachably connected to the watch face 21; when a to-be-connected object is a bracelet display screen 32, the connection assembly is detachably connected to the bracelet display screen 32; and when a to-be-connected object is a chip and/or display screen of a smart ring, the connection assembly is detachably connected to the smart ring.

It should be noted that during assembly of the connection assembly, the second clamping member can be placed in the accommodating groove of the support member and the fixing part of the first clamping member is buckled with the support member, so that the second clamping member can be placed in the accommodating space formed by the fixing part and the accommodating groove. Here, the second clamping part of the second clamping member is arranged in a direction of the opening of the accommodating space, so that the second clamping part can be extended or retracted from the opening of the accommodating space.

In some embodiments, the fixing part and the support member may be fixed after the fixing part is buckled with the support member. For example, screw holes may be formed in the fixing part and the support member respectively, and then screws pass through the screw holes in the fixing part and the support member respectively, to fix the fixing part and the support member together. In other embodiments, it is also possible to arrange clamping structures cooperated mutually on the fixing part and the support member respectively, and the fixing between the fixing part and the support member is achieved by the clamping structures. In other embodiments, the fixing between the fixing part and the support member may be achieved by an injection molding process or a welding process, or by other removable means, which is not limited herein.

In an embodiment of the disclosure, the first clamping part may be clamped into or separated from the first clamping groove in the to-be connected body by an external force. By taking the to-be-connected body being a watch face 21 as an example, a first clamping groove may be formed in the watch face 21, and in the implementation process, the first clamping part may be aligned with the first clamping groove and is inserted into the first clamping groove, or the first clamping part may be extracted from the first clamping groove to be separated from the first clamping groove. In some embodiments, a depth of the first clamping groove is the same as a length of the first clamping part. In other embodiments, a clamping face of the first clamping part is parallel to a display face of the to-be-connected body.

Figure 4:
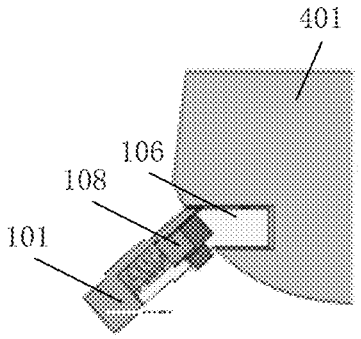
FIG. 4 is a schematic diagram illustrating clamping of a first clamping member and a to-be-connected body according to an embodiment.

FIG. 4 is a schematic diagram illustrating clamping of a first clamping member and a to-be-connected body according to an embodiment. As shown in FIG. 4, the first clamping part 106 may be clamped into a first clamping groove of a to-be-connected body 401, and the second clamping part 108 is located in the accommodating space. In the implementation process, the first clamping part may be pushed directly into the first clamping groove by an external force, the first clamping part may be also inserted into the first clamping groove by other tools or buttons, for example, an elastic member may be arranged on a side, facing away from a clamping direction, of the first clamping part, and the insertion and extraction of the first clamping part may be controlled by the elastic member, which is not limited herein.

In an embodiment of the disclosure, the to-be-connected body is further provided with a second clamping groove, the second clamping part extends from the accommodating space to the second clamping groove when the second clamping part is aligned with the opening of the accommodating space. Correspondingly, the second clamping part may be separated from the second clamping groove when the second clamping part retracts into the accommodating space.

In some embodiments, a depth of the second clamping groove is the same as a length of the second clamping part. In other embodiments, the clamping face of the second clamping part is not parallel to the display face of the to-be-connected body.

Figure 5:
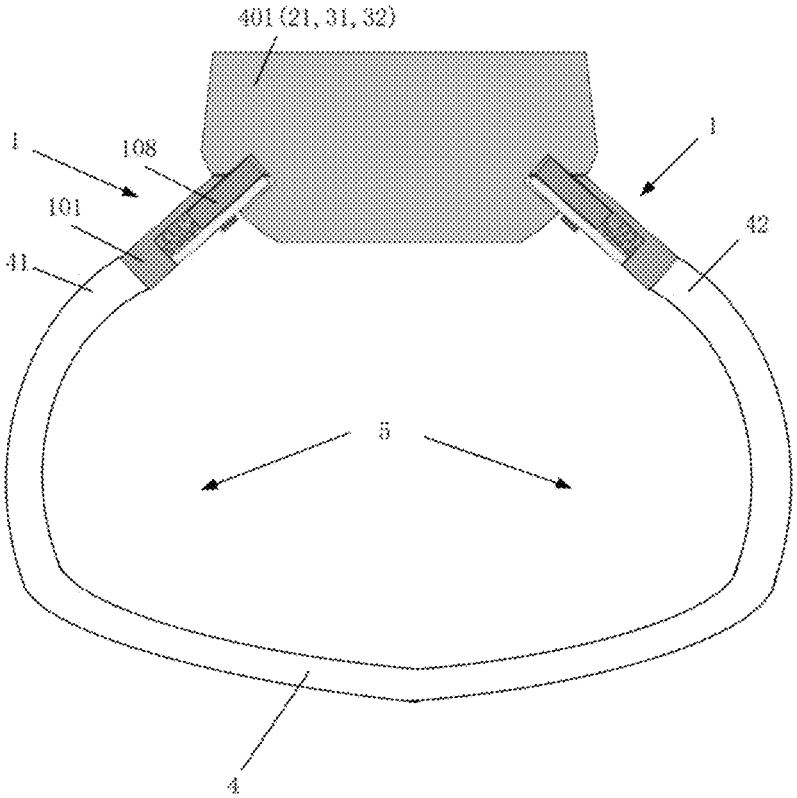
FIG. 5 is a schematic diagram illustrating clamping of a second clamping member and a to-be-connected body according to an embodiment.

FIG. 5 is a schematic diagram illustrating clamping of a second clamping member and a to-be-connected body according to an embodiment. As shown in FIG. 5, the second clamping part 108 may be clamped into a second clamping groove of the to-be connected body 401. In the implementation process, the second clamping part can be pushed directly into the second clamping groove by an external force, and the second clamping part may be also inserted into the second clamping groove by other tools or buttons, for example, an elastic member may be arranged on a side, facing away from a clamping direction, of the second clamping part, and the insertion and extraction of the second clamping part may be controlled by the elastic member, which is not limited herein.

In the implementation process, the second clamping part may be controlled to retract into the accommodating space first, the first clamping part is aligned with the first clamping groove, the first clamping part is inserted into the first clamping groove, and after the first clamping part is inserted into the first clamping groove, the second clamping part is controlled to extend until the second clamping part is inserted into the second clamping groove to connect the connection assembly to the to-be-connected body.

Figure 6:
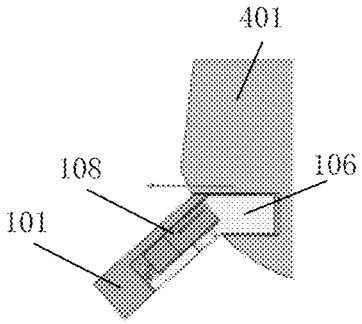
FIG. 6 is a schematic diagram illustrating extraction of a connection assembly according to an embodiment.

When the connection assembly needs to be separated from the to-be-connected body, the second clamping part may be extracted from the second clamping groove first, and then the first clamping part is extracted from the first clamping groove. FIG. 6 is a schematic diagram illustrating extraction of a connection assembly according to an embodiment, as shown in FIG. 6, a direction of extraction of the second clamping part 108 is the same as a direction of an opening of the second clamping groove, and a direction of extraction of the first clamping part 106 is the same as a direction of an opening of the first clamping groove.

In the embodiment of the disclosure, the first clamping member and the second clamping member are arranged respectively, the first clamping part of the first clamping member is clamped into or separated from the first clamping groove of the to-be-connected body by the external force, the second clamping part of the second clamping member is extendable and retractable, so that the second clamping part can be clamped into or separated from the second clamping groove of the to-be-connected body, and the clamping face of the first clamping part and the clamping face of the second clamping part are located at the different planes, so that the detachable connection between the connection assembly and the to-be-connected body may be achieved by the external force and the mutual cooperation of the first clamping member and the second clamping member.

Compared with the mutual cooperation of multiple components such as a hook, a spring and a pull rod in the related art, the disclosure has simpler design of the mutual cooperation of the first clamping member and the second clamping member and has more convenient disassembly. In addition, on the basis of the presence of the connection assembly in the disclosure, it needs to respectively provide the clamping grooves, which are adaptive to the first clamping part and the second clamping part, in the to-be-connected body, without requiring additional hardware support, so that the operation is easy, and the commonality is high.

In some embodiments, the second clamping member 107 further includes:

an elastic member 701, being connected to the second clamping part 108, and located on a side, facing away from the opening of the accommodating space, of the second clamping part 108. The elastic member 701 elastically deforms by an external force to drive the second clamping part 108 to be extended or retracted from the opening.

Figure 7:
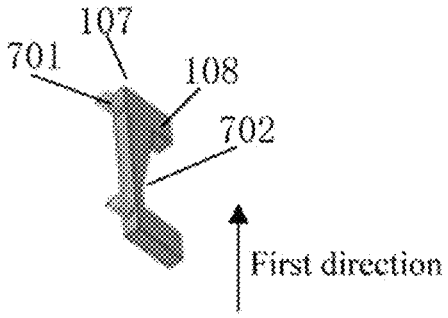
FIG. 7 is a schematic diagram illustrating a second clamping member according to an embodiment.

FIG. 7 is a schematic diagram illustrating a second clamping member according to an embodiment. As shown in FIG. 7, the second clamping member 107 includes the elastic member 701 and the second clamping part 108. The elastic member 701 includes springs, clips, or other components, which elastically deform by an external force, which is not limited herein.

In some embodiments, one elastic member or a plurality of elastic members may be arranged on the second clamping part. For embodiments in which a plurality of elastic members is arranged, the plurality of elastic members may be respectively arranged on the side, facing away from the opening of the accommodating space, of the second clamping part at intervals, and spacing distances between the respective elastic members may be the same to keep the second clamping part stable in the extension or retraction process.

In an embodiment of the disclosure, the extension and retraction of the second clamping part may be controlled based on deformation of the elastic member by arranging the elastic member on the second clamping part. For example, as shown in FIG. 6, when the elastic member is in a compression state, the second clamping part retracts into the accommodating space, and as shown in FIG. 5, when the elastic member is in an extension state, the second clamping part extends into the second clamping groove.

In the disclosure, the extension and retraction of the second clamping part by elastic deformation of the elastic member may improve the use convenience of the connection assembly as compared to the extension and retraction of the second clamping part controlled by direct use of an external force.

In some embodiments, the connection assembly further includes:

a slider 801, including: an operating part 802 and a sliding part 803;

the second clamping member 107 further includes:

a sliding groove 702, the sliding part 803 of the slider 801 is in the sliding groove 702, and the operating part 802 being capable of driving the sliding part 803 to move in the sliding groove 702 by an external force to generate an extrusion force on a wall of the sliding groove 702, which is transmitted to the elastic member 701 by a body of the second clamping part 108 to cause the elastic member 701 to elastically deform.

Figure 8:
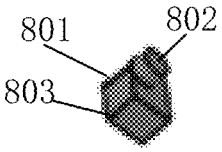
FIG. 8 is a schematic diagram illustrating a slider according to an embodiment.
Figure 9:
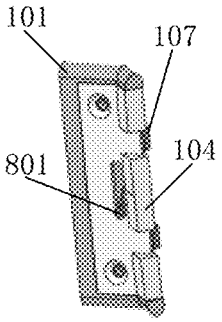
FIG. 9 is a schematic diagram III illustrating a connection assembly according to an embodiment.

FIG. 8 is a schematic diagram illustrating a slider according to an embodiment. As shown in FIG. 8, the slider 801 includes the operating part 802 and the sliding part 803, and during assembly, the sliding part 803 of the slider 801 may be arranged inside the sliding groove 702 of the second clamping member 107 in FIG. 7. FIG. 9 is a schematic diagram III illustrating a connection assembly according to an embodiment. As shown in FIG. 9, the sliding part of the slider 801 is in the sliding groove of the second clamping member 107, and when the second clamping member 107 is arranged in the accommodating space, the operating part of the slider 801 may extend to the outside of the first clamping member 104, so that a user controls the sliding part by the operating part conveniently.

In some embodiments, a volume of the sliding part is greater than that of the operating part.

In some embodiments, the fixing part of the first clamping member includes a through-hole through which the operating part passes to control the sliding part to move in the sliding groove.

Here, in order to extend the operating part to the outside of the first clamping part, a through-hole is provided in the fixing part of the first clamping part, so that the operating part may pass through the through-hole to control the sliding part to move in the sliding groove. In some embodiments, in order to reduce the possibility that the sliding part separates from the through-hole, a size of the sliding part is larger than a diameter of the through-hole. The size of the sliding part includes a length and a width of the sliding part.

Figure 10:
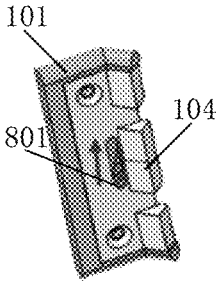
FIG. 10 is a schematic diagram IV illustrating a connection assembly according to an embodiment.

In some embodiments, the operating part and the sliding part may be fixedly connected, for example, the sliding part and the operating part are integrally formed, and in other embodiments, the operating part and the sliding part may be detachably connected, as long as the control on the sliding part can be achieved by the operating part. The connection between the operating part and the sliding part is not limited by the disclosure. FIG. 10 is a schematic diagram IV illustrating a connection assembly according to an embodiment. As shown in FIG. 10, the operating part of the slider 801 may extend out through the through-hole in the fixing part of the first clamping part, and in the use process, the sliding part may be controlled by the operating part to move in a direction of an arrow shown in FIG. 10 to control the elastic deformation of the elastic member, so as to provide operation convenience for a user.

In an embodiment of the disclosure, the elastic deformation of the elastic member can be controlled by the slider, and thus the extension and retraction of the second clamping part is controlled, so as to save more efforts. The through-hole is arranged, and the operating part of the slider extends to the outside of the first clamping member by the through-hole, so that the operation convenience can be provided for a user.

In some embodiments, a wall, which is in contact with the sliding part, in the sliding groove, is a slope.

As shown in FIG. 7, a wall, which is in contact with the sliding part, in the sliding groove is a slope. In the implementation process, due to the limited volume of the accommodating space, when the sliding part is arranged in the sliding groove, if the sliding part is pushed by the operating part in a first direction indicated in FIG. 7, the sliding part generates an extrusion force on the second clamping part, the extrusion force is applied to the elastic member by the body of the second clamping part, and at the moment, the elastic member is compressed to drive the second clamping part to retract in a direction facing away from the opening.

Upon removal of the external force applied by the operating part, the sliding part automatically moves in a second direction opposite to the first direction due to the elastic action of the elastic member to achieve a reset effect. In the embodiment of the disclosure, the wall, which is in contact with the sliding part, in the sliding groove is set to be the slope to control the elastic member to extend or retract conveniently, and the automatic reset of the slider without the external force can reduce the operating force to be applied by a user as compared to the manual reset of the slider, so as to improve the user experience.

In some embodiments, when an external force acts on the operating part, the elastic member is in a compression state, and the second clamping part is separated from the second clamping groove. When the external force is removed, the elastic member is in an extension state, and the second clamping part is clamped into the first clamping groove.

Figure 11:
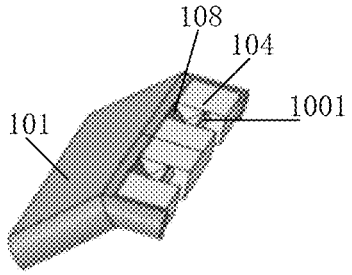
FIG. 11 is a schematic diagram V illustrating a connection assembly according to an embodiment.

As shown in FIG. 10, when the operating part receives an external force in the direction of the arrow in FIG. 10, the compression of the elastic member may be controlled by the sliding part is in the sliding groove, so that the second clamping part to be separated from the second clamping groove and retract into the accommodating space. FIG. 11 is a schematic diagram V illustrating a connection assembly according to an embodiment, and as shown in FIG. 11, the second clamping part 108 retracts into the accommodating space.

Figure 12:
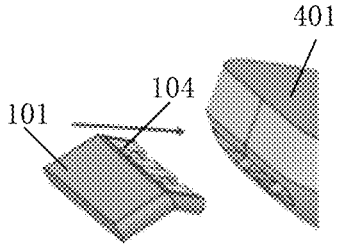
FIG. 12 is a schematic diagram illustrating insertion of a first clamping part according to an embodiment.

In some embodiments, after the second clamping part retracts into the accommodating space, an external force (first external force) is applied to the operating part continuously, and the first clamping part may be pushed into the first clamping groove by an external force (second external force). FIG. 12 is a schematic diagram illustrating insertion of a first clamping part according to an embodiment. As shown in FIG. 12, the first clamping part may be aligned with the first clamping groove and the connection assembly may move until the first clamping part is inserted into the first clamping groove. After the first clamping part is inserted into the first clamping groove, the external force applied to the operating part may be removed, and at the moment, the slider is reset and the second clamping part extends into the second clamping groove to achieve the clamping of the connection assembly and the to-be-connected body.

Figure 13:
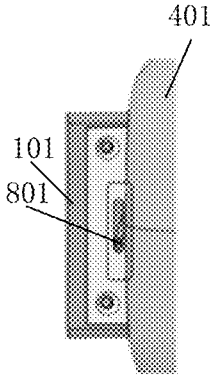
FIG. 13 is a schematic diagram VI illustrating a connection assembly according to an embodiment.

FIG. 13 is a schematic diagram VI illustrating a connection assembly according to an embodiment, and as shown FIG. 13, after the external force applied to the operating part is removed, the second clamping part extends to the second clamping groove and the slider 801 is reset.

In some embodiments, the first clamping part includes at least one first stop block, the second clamping part includes at least one second stop block. The first and second stop blocks are arranged at intervals.

Here, there may be a plurality of first stop blocks, and correspondingly, there also may be a plurality of second stop blocks. As shown in FIG. 11, the first clamping part may be provided with three first stop blocks, the second clamping part may be provided with two second stop blocks, two spacer regions are formed between the three first stop blocks, and the two second stop blocks of the second clamping part are arranged in the two spacer regions at intervals. In the implementation process, the two second stop blocks of the second clamping part can be extended or retracted in the two spacer regions through the opening of the accommodating space.

In some embodiments, a support part may also be arranged on the second clamping member and used to support the second clamping part when the second clamping part extends out. As shown in FIG. 11, a support part 1001 may be arranged on the second clamping member. In some embodiments, the support part may include at least one support block and the number of the support block is the same as the number of the second stop block, and each support block is used to support one second stop block.

An embodiment of the disclosure also provides a wearable device, including:

a device body and a band-shaped connector 4; and the connection assembly of any one of the above embodiments, the support member of the connection assembly being connected to the band-shaped connector 4 and the first clamping member and the second clamping member of the connection assembly being connected to the device body;

in a wearing state, the connection assembly, the band-shaped connector 4, and the device body form a wearing loop 5.

Here, the device body may be the to-be-connected body of any one of the above embodiments. It should be noted that the band-shaped connector 4, the device body, and the connection assembly are connected to form the wearing loop 5, which facilitates that a user wears the wearable device and conforms to the human engineering.

In some embodiments, the device body includes a first clamping groove and a second clamping groove. The first clamping part of the first clamping member is clamped into the first clamping groove by an external force, and the second clamping part of the second clamping member is clamped into the second clamping groove when in an extension state. An opening of the second clamping groove and an opening of the first clamping groove are in different directions.

In an embodiment of the disclosure, the first clamping part can be clamped into or separated from the first clamping groove in the device body by an external force. By taking the device body being a watch face 21 as an example, a first clamping groove may be formed in the watch face 21, and in the implementation process, the first clamping part may be aligned with the first clamping groove and is inserted into the first clamping groove, or the first clamping part may be extracted from the first clamping groove to be separated from the first clamping groove. In some embodiments, a depth of the first clamping groove is the same as a length of the first clamping part. In other embodiments, a clamping face of the first clamping part is parallel to a display face of the device body.

In an embodiment of the disclosure, the device body is further provided with a second clamping groove, the second clamping part extends from the accommodating space to the second clamping groove when the second clamping part is aligned with the opening of the accommodating space. Correspondingly, the second clamping part may be separated from the second clamping groove when the second clamping part retracts into the accommodating space.

In some embodiments, a depth of the second clamping groove is the same as a length of the second clamping part. In other embodiments, the clamping face of the second clamping part is not parallel to the display face of the device body.

In the implementation process, the second clamping part may be controlled to retract into the accommodating space first, the first clamping part is aligned with the first clamping groove, the first clamping part is inserted into the first clamping groove, and after the first clamping part is inserted into the first clamping groove, the second clamping part is controlled to extend until the second clamping part is inserted into the second clamping groove to connect the connection assembly to the device body.

The disclosure has simpler design of the mutual cooperation of the first clamping member and the second clamping member and has more convenient disassembly. In addition, on the basis of the presence of the connection assembly in the disclosure, it needs to respectively provide the clamping grooves, which are adaptive to the first clamping part and the second clamping part, on the device body, without requiring additional hardware support, so that the operation is easy, the commonality is high, and in the use process, a user can rapidly change different band-shaped connectors.

In some embodiments, there are two connection assemblies 1 which are connected to two opposite ends of the device body respectively. The band-shaped connector 4 includes: a first connection part 41 and a second connection part 42, which are respectively located at two opposite ends of the band-shaped connector 4. In a wearing state of the wearable device, the first connection part 41 is connected to a support member of one of the connection assemblies, and the second connection part 42 is connected to a support member of the other connection assembly.

Here, the connection between the first and second connection parts and the support members of the connection assemblies may be achieved by clamping, or by fixing, which is not limited herein.

In other embodiments, there may be one connection assembly. In the case that there is one connection assembly, the connection assembly may be located at one end of the device body, the first connection part 41 of the band-shaped connector 4 is connected to a support member of the connection assembly, and the second connection part 42 is connected to the other end of the device body. The number of the connection assembly may be set, and is not limited herein.

In some embodiments, the wearable device includes a smartwatch 2; the device body is a watch face 21. Alternatively, the wearable device includes a smart bracelet 3; and the device body includes: a bracelet chip 31 or a bracelet display screen 32.

Those skilled in the art will easily conceive other implementation solutions of the disclosure after considering the specification and practicing the disclosure disclosed herein. The disclosure is intended to cover any variations, uses or adaptive changes of the disclosure, and these variations, uses or adaptive changes follow the general principle of the disclosure and include the general knowledge or customary technical means in the art, which are not disclosed by the disclosure.

It should be understood that the disclosure is not limited to the precise structures that have been described above and illustrated in the accompanying drawings, and may be subjected to various modifications and changes without departing from the scope of the disclosure. The scope of the disclosure is limited only by the appended claims.

The invention claimed is:

1. A connection assembly, comprising:

a support member, comprising: a support body and an accommodating groove on the support body;

a first clamping member, comprising: a fixing part and a first clamping part, the fixing part and the support member being buckled to form an accommodating space with the accommodating groove, the accommodating space having an opening, and the first clamping part is detachably clamped to a first clamping groove in a to-be-connected body by an external force;

a second clamping member, comprising: a second clamping part which is at least partially in the accommodating space and can be partially extended or retracted from the opening of the accommodating space to be clamped into or separated from a second clamping groove in the to-be-connected body;

a clamping face of the first clamping part and a clamping face of the second clamping part that are in different planes, wherein:

the first clamping part comprises at least one first stop block;

the second clamping part comprises at least one second stop block; and the at least one first stop block and the at least one second stop block are arranged at intervals; and a slider, comprising: an operating part and a sliding part, the second clamping member further comprising:

an elastic member which is connected to the second clamping part and located on a side, facing away from the opening, of the second clamping part, wherein the elastic member elastically deforms by an external force to drive the second clamping part to be partially extended or retracted from the opening; and a sliding groove, wherein the sliding part of the slider is in the sliding groove, the operating part can drive the sliding part to move in the sliding groove by an external force to generate an extrusion force to a wall of the sliding groove, and the extrusion force is transmitted to the elastic member by a body of the second clamping part to cause the elastic member to elastically deform.

2. The connection assembly according to claim 1, wherein the wall, which is in contact with the sliding part, in the sliding groove, is a slope.

3. The connection assembly according to claim 1, wherein the fixing part of the first clamping member comprises:

a through-hole through which the operating part passes to control the sliding part to move in the sliding groove.

4. The connection assembly according to claim 1, wherein when the external force acts on the operating part, the elastic member is in a compression state, and the second clamping part is separated from the second clamping groove; and when the external force is removed, the elastic member is in an extension state and the second clamping part is clamped into the second clamping groove.

5. A wearable device, comprising:

a device body, comprising: a first clamping groove and a second clamping groove;

a band-shaped connector; and a connection assembly, comprising:

a support member is connected to the band-shaped connector, and comprises a support body and an accommodating groove on the support body;

a first clamping member, comprising: a fixing part and a first clamping part, the fixing part and the support member being buckled to form an accommodating space with the accommodating groove, the accommodating space having an opening, and the first clamping part is detachable clamped to the first clamping groove by an external force;

a second clamping member, comprising: a second clamping part which is at least partially in the accommodating space and can be partially extended or retracted from the opening of the accommodating space to be clamped into or separated from the second clamping groove;

a clamping face of the first clamping part and a clamping face of the second clamping part that are in different planes, wherein in a wearing state, the connection assembly, the band-shaped connector and the device body form a wearing loop, wherein:

the first clamping part comprises at least one first stop block;

the second clamping part comprises at least one second stop block; and the at least one first stop block and the at least one second stop block are arranged at intervals; and a slider, comprising: an operating part and a sliding part, the second clamping member further comprising:

an elastic member which is connected to the second clamping part and located on a side, facing away from the opening, of the second clamping part, wherein the elastic member elastically deforms by an external force to drive the second clamping part to be partially extended or retracted from the opening; and a sliding groove, wherein the sliding part of the slider is in the sliding groove, the operating part can drive the sliding part to move in the sliding groove by an external force to generate an extrusion force to a wall of the sliding groove, and the extrusion force is transmitted to the elastic member by a body of the second clamping part to cause the elastic member to elastically deform.

6. The wearable device according to claim 5, wherein the wall, which is in contact with the sliding part, in the sliding groove, is a slope.

7. The wearable device according to claim 5, wherein the fixing part of the first clamping member comprises:

a through-hole through which the operating part passes to control the sliding part to move in the sliding groove.

8. The wearable device according to claim 5, wherein when the external force acts on the operating part, the elastic member is in a compression state, and the second clamping part is separated from the second clamping groove; and when the external force is removed, the elastic member is in an extension state and the second clamping part is clamped into the second clamping groove.

9. The wearable device according to claim 5, wherein an opening of the second clamping groove and an opening of the first clamping groove are in different directions.

10. The wearable device according to claim 5, wherein there are two connection assemblies which are connected to two opposite ends of the device body;

the band-shaped connector comprises: a first connection part and a second connection part, which are located at two opposite ends of the band-shaped connector respectively; and in the wearing state of the wearable device, the first connection part is connected to a support member of one of the two connection assemblies, and the second connection part is connected to a support member of the other one of the two connection assemblies.

11. The wearable device according to claim 5, wherein the wearable device comprises a smartwatch; and wherein the device body is a watch face.

12. The wearable device according to claim 5, wherein the wearable device comprises a smart bracelet; and wherein the device body comprises a bracelet chip or a bracelet display screen.

* * * * *